United States Patent [19]

Amundson et al.

[11] Patent Number: 4,663,995

[45] Date of Patent: May 12, 1987

[54] DEVICE FOR REMOVING OR STRIPPING MATERIAL

[75] Inventors: Frank M. Amundson; Herbert C. Manners; Paul M. Jeffries, all of Punxsutawney, Pa.

[73] Assignee: Femco Machine Co., Punxsutawney, Pa.

[21] Appl. No.: 847,279

[22] Filed: Apr. 2, 1986

[51] Int. Cl.[4] ..... B25B 33/00

[52] U.S. Cl. ..... 81/45; 30/169; 254/131.5; 294/53.5

[58] Field of Search ..... 30/169, 478, 480, 485, 30/488, 492; 81/43; 13/236 R; 294/50.8, 50.9, 53.5; 254/131.5

[56] References Cited

U.S. PATENT DOCUMENTS 1,559,829 11/1925 Wolfe ..... 294/53.5
4,091,535 5/1978 Lehrter ..... 30/169
4,147,329 4/1979 Rodriguez ..... 294/50.9 X
4,547,010 10/1985 Camp ..... 294/50.9

*Primary Examiner*—Douglas D. Watts
*Attorney, Agent, or Firm*—Reed Smith Shaw & McClay

[57] ABSTRACT

A device for removing material, preferably roofing material, consisting of a baseplate; a shaft member secured at one end to a guide handle and at the other end to the baseplate; a lifting plate including a blade-like leading section and a trailing section; an opening located in the trailing section of the lifting plate to permit the lower end of the shaft member to pass therethrough; a fulcrum means operatively connected to the baseplate and the lifting plate; an actuating means located on a guide handle and connected to a drive means; and a drive means to depress the trailing section of the lifting plate thereby rotating the lifting plate about the fulcrum means to move the blade-like leading section of the lifting plate into a generally parallel spaced-apart position with respect to the baseplate.

9 Claims, 8 Drawing Figures

15
15H
43R
11S
22
11
17
16
15H
43L
11S 16
22
12
15A
11S
15
8
11
8
19
15H
43
26
18
35
29
31
27
25
28
32
34
33
22

36
34
37
33
41

DEVICE FOR REMOVING OR STRIPPING MATERIAL

FIELD OF THE INVENTION

The present invention relates to devices for removing or stripping material, preferably roofing material from a roof deck.

BACKGROUND OF THE INVENTION

Houses and buildings are generally constructed with inclined roofs. The roofs are generally covered with a plurality of overlapping, horizontal, aligned rows of shingles, although the roof may be of the built-up, flat or low pitched type employing rolled roofing materials.

Generally, with a shingle roof, each row includes a plurality of horizontally aligned individual rectangular shingles. The first row is laid across an edge of the roof and is fastened in place. Each successive layer or row is secured to the roof deck with the lower portion overlapping the preceding row sufficiently to cover the fasteners used to attach the immediately preceding lower row. With a built-up, flat or low pitched type roof the material is laid in strips in an overlapping relationship and fastened in place. In modern roofing, the overlapping portion is also secured to the underlying roofing material by a suitable adhesive.

A roof needs periodic removal of the roofing material either in part or in total to improve the life of the roof and to permit inspection of the roof deck. Since the shingles or rolled roofing materials lie flat and have a plurality of fasteners securing them to the roof deck, this is an all but impossible task to accomplish effectively by hand. More importantly, a rough roof deck can adversely affect the tightness of the new roofing and particularly its ability to resist weather and high winds. Numerous tools have been provided to strip roofing material from a roof deck, but all such tools have to date suffered from various drawbacks in actual practice. For example, U.S. Pat. No. 4,182,390 discloses a manual roof shingle remover tool; U.S. Pat. No. 4,203,210 discloses a shingle stripping tool shaped like a modified spade; and U.S. Pat. No. 4,324,042 discloses a rake-like device rollable across an inclined roof.

SUMMARY OF THE INVENTION

Generally, the present invention provides an improved device for removing or stripping material, preferably roofing material from an underlying roof deck. The device can be used on any roof deck containing roofing materials such as the built-up, flat or low pitched types. However, it is particularly useful on the common double-sloping roofs of buildings and houses. The present invention reduces the time and manual exertion that is normally required to remove old and worn roofing material from existing roofs. It also minimizes the damage to the surface of the roof deck that occurs when an uneven force is applied such as in manual stripping efforts.

The present invention provides a device which can be readily inserted beneath roofing material so as to elevate it from the roof deck thereby effecting a clean separation with minimal physical exertion while maintaining the safety of the operator. The material removing device of the present invention also incorporates a fulcrum means which will not damage the underlying roof deck, and an actuating means which minimizes the likelihood that the operators hands will be exposed to the operating portion of the device.

According to the present invention, there is provided a material removing device, preferably used to remove roofing material, comprising: a planar rigid baseplate; a support shaft member secured to a guide handle at its upper end and secured at its lower end to the baseplate; a lifting plate including a blade-like leading section and a handle-shaped trailing section, both of which are disposed in substantially the same plane; an opening located in the trailing section of the lifting plate to permit the lower end of the shaft member to pass therethrough; a fulcrum means operatively secured to the upper side of the baseplate and to the lower side of the lifting plate; an actuating means located on the guide handle and connected to a drive means; and a drive means with a first end portion being connected to the shaft member, and a second end portion being hingeably secured to the trailing section of the lifting plate, whereby actuation of the drive means downwardly depresses the trailing section of the lifting plate thereby rotating the lifting plate about the fulcrum means and moving the leading section of the lifting plate into a generally parallel spaced-apart position with respect to the baseplate.

Other features and advantages of the present invention will be apparent from the following detailed description and with reference to the accompanying drawings.

DETAILED DESCRIPTION OF THE INVENTION

Figure 1:
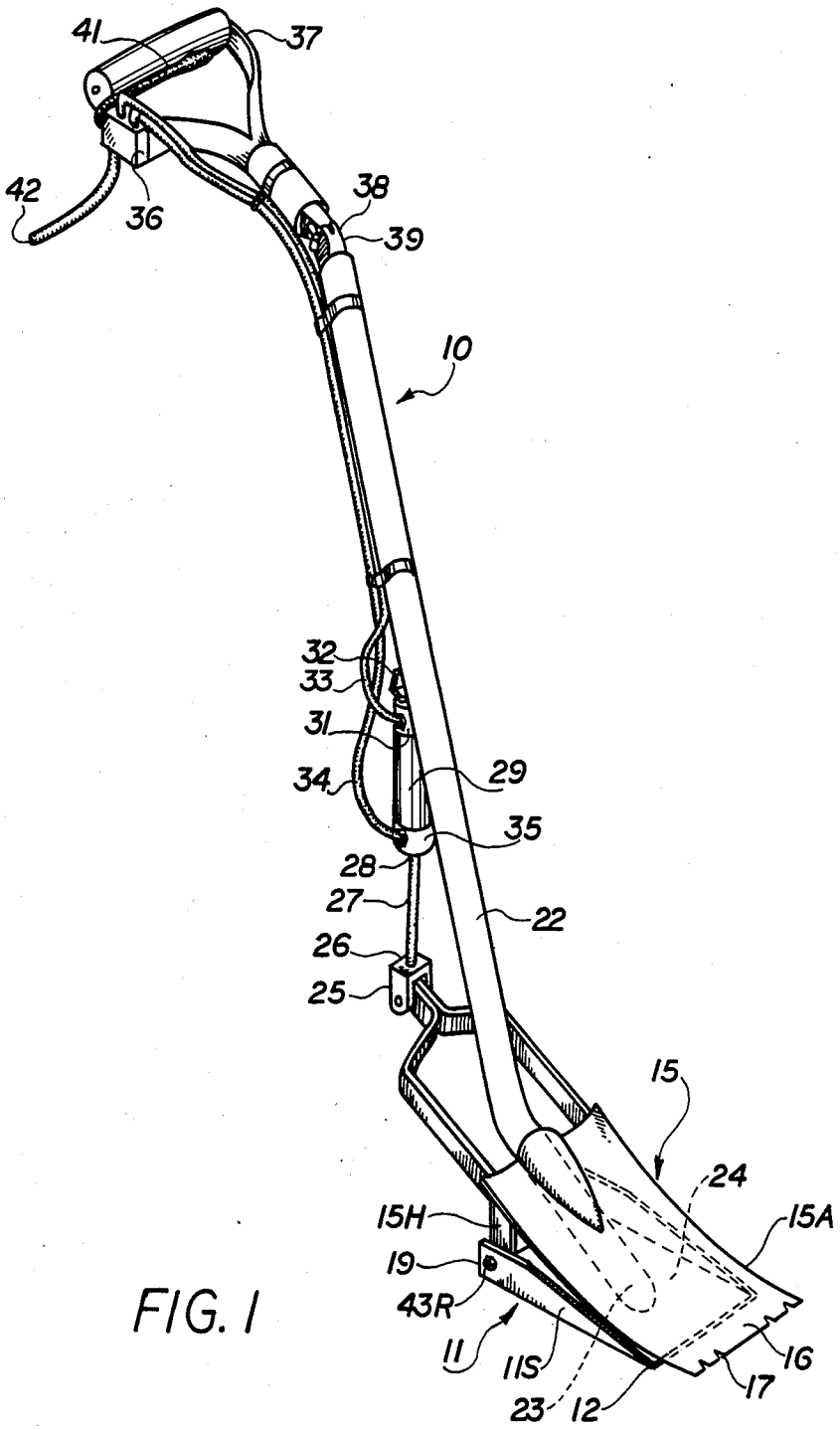
FIG. 1 is a perspective view of a device for removing material, preferably roofing material, embodying the teachings of the present invention.

As shown in FIG. 1, the device for removing material, preferably roofing material, is generally designated 10. It consists of a rigid baseplate 11, usually metallic in composition, and conveniently of a channel-like, rectangular cross-section, with a forward edge 12 and a square cut trailing edge 19 (both better seen in FIG. 2). Tapered vertical edges 11S form a linear contact point for the underside (not seen) of upwardly curved lifting plate 15. Lifting plate 15 includes parallel downward projections 15H positioned in the area of the pivot or hinge point to be described.

Leading section 15A of lifting plate 15 including leading edge 16 presents a blade-like appearance which facilitates slipping the leading section 15A of lifting plate 15 under roofing materials while it is still adjacent to baseplate 11. Leading edge 16 preferably has a plurality of spaced-apart serrations 17 (at least 3) cut into it. These serrations function as fastened engaging means, so that the fasteners may be pried up from the roof deck through a pivoting action of a fulcrum means to be described. The back part of leading section 15A, preferably, is bent to permit clearance of shaft member 22 as shown in FIG. 1.

Trailing section 18 of lifting plate 15 typically forms a handle-shaped projection generally extending rearwardly of trailing edge 19 of baseplate 11. It preferably has a length somewhat longer than blade-like leading section 15A, thereby gaining a mechanical advantage of at least 1.3:1.0. Trailing section 18 is substantially "U"-shaped or "Y"-shaped and is fabricated of a durable kind of metal, such as alloy steel or aluminum, which can withstand the stress of numerous actuation cycles to lift and remove roofing material.

Shaft member 22 is made of aluminum or tubular steel. Shaft member 22 is pinned at its lower end 23 to the middle section 24 of baseplate 11 and is also positioned essentially centrally thereon.

Attached to the rearward part of trailing section 18 is a metal shackle 25, preferably of a clevis-type, which hingeably anchors the lower end 26 of a piston rod 27. The upper end 28 of piston rod 27 is operably connected to a reciprocable fluid-actuated cylinder and piston 29. The piston rod 27, and cylinder and piston 29 together constitute the preferred drive means.

Piston and cylinder 29 are necessarily aligned toward and connected to the rearward part of trailing section 18 to permit facile depression thereof upon actuation of the drive means. Upper end 31 of piston and cylinder 29 is conveniently anchored to shaft member 22 via a mounting bracket 32. Tubular fluid lines 33 and 34 are operatively connected to the opposite ends 31 and 35 of piston and cylinder 29. These lines run along the upper length of shaft member 22, and can be loosely secured thereto by taping, or the like. They are connected to a standard control (open/close fluid valve) box 36, which is affixed to a guide handle 37. As shown in FIG. 1, guide handle 37 may be attached to an adjustable knuckle 38, which is hingeably connected to the upper notched end 39 of shaft member 22. Adjustable knuckle 38 is not required if guide handle 37 is rigidly connected to shaft member 22 in a straight line as shown in FIG. 2.

Figures 2, 3, 8:
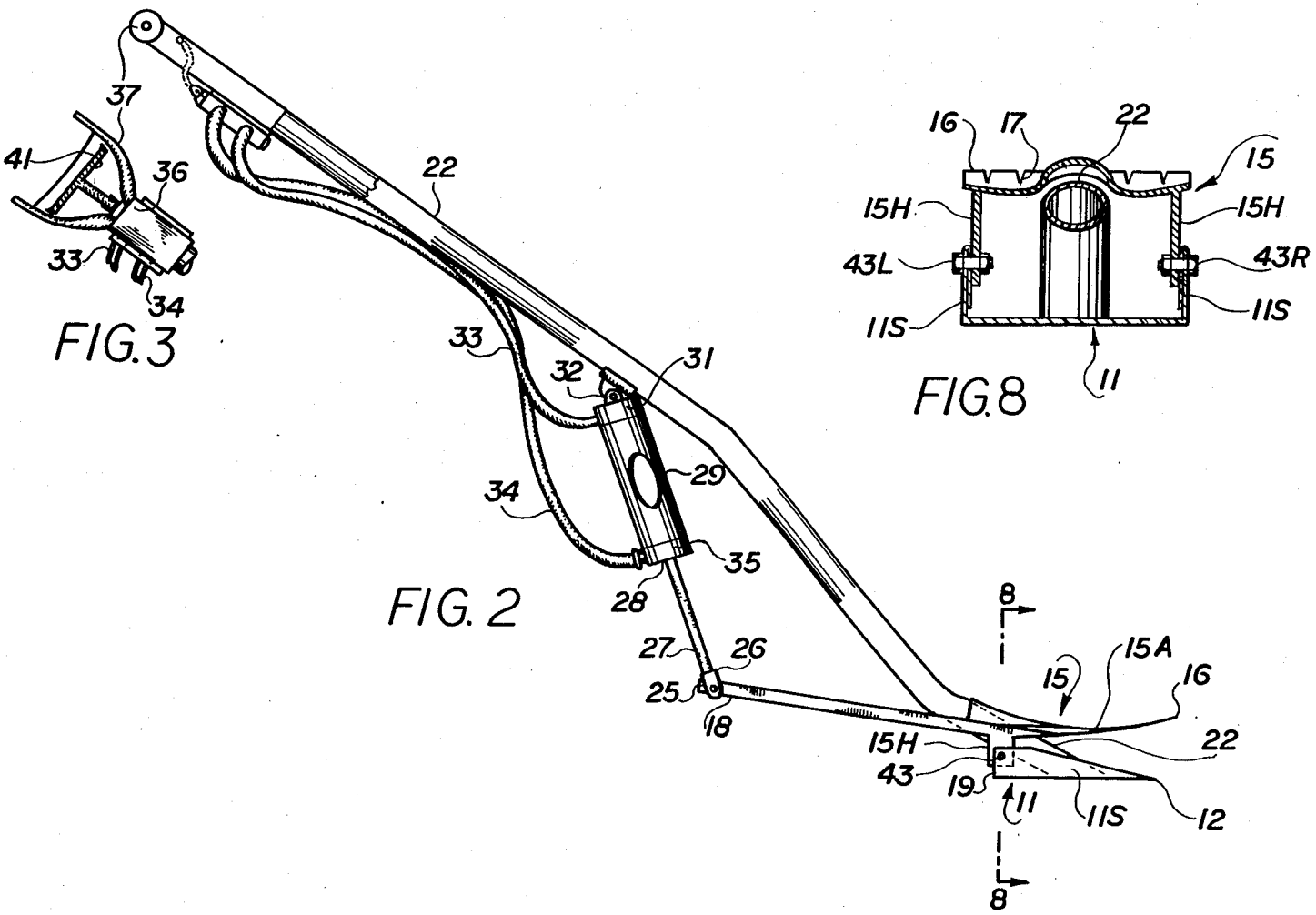
FIG. 2 is a full side elevation view of the device of FIG. 1 showing the angular relationship of the baseplate and lifting plate while the device is in the activated mode.
FIG. 3 is a top plan partial view of the actuating means and the guide handle.
FIG. 8 is a full sectional view taken along line 8—8 of FIG. 2, showing the fulcrum means.

Operatively associated within the grip portion of guide handle 37 is an actuating means, preferably a spring-biased trigger means 41 as shown in FIG. 3. The actuating means controls the fluid to supply lines 33 and 34. Trigger means 41 is alternately actuated to drive piston rod 27 downwardly, or to retract it upwardly, as dictated by the device operator.

In one preferred embodiment, a compressed air supply reaches box 36, via a flexible air supply line 42. This runs to a small compressor unit (not seen) usually positioned at ground level of the building on which the old roofing material is being replaced. Such hand controls and associated fluid flow control valves are well known in the art.

Focusing on the interplay of baseplate 11 and lifting plate 15 one can see in FIG. 2 one side terminal of a fulcrum means 43. Fulcrum means 43 comprises the spaced-apart parallel vertical sides 11S of baseplate 11 which are adjacent to the spaced-apart downward projections 15H of lifting plate 15. Fulcrum means 43 is positioned near trailing edge 19 of baseplate 11. The axis of fulcrum means 43 is defined by two threaded bolts, 43L and 43R, aligning and rotating tying lifting plate 15 to baseplate 11, as best seen in FIG. 8. This insures balanced lifting of leading edge 16 when the material removal device is activated to remove or strip material.

The fulcrum action alternately rests lifting plate 15 on baseplate 11 and moves lifting plate 15 away via the aligned bolts, 43L and 43R, that define the axis of rotation of lifting plate 15. When lifting plate 15 and baseplate 11 are in contact, so as to permit their sliding under a piece of roofing material, such as a shingle, they present an acute angle of less than 45 degrees, preferably about 30 degrees.

Still referring to FIG. 2, which shows the device in the actuated mode, the vertical height of the apparatus from baseplate 11 to guide handle 37 is preferably on the order of 37 inches. The horizontal length from leading edge 16 of lifting plate 15 to guide handle 37 is preferably about 46 inches. The length of baseplate 11 is preferably about 8 inches. The length of lifting plate 15 from its leading edge 16 to the back edge of trailing section 18 is preferably 20.88 inches. When the device is in the maximum lift position (as shown in FIG. 2) with baseplate 11 on the roof deck, leading edge 16 is preferably 2.88 inches above the roof deck and the back edge of trailing section 18 is preferably 3.25 inches from the roof deck. The axis of fulcrum means 43 is preferably about 1.13 inches above the roof deck.

Figure 7:
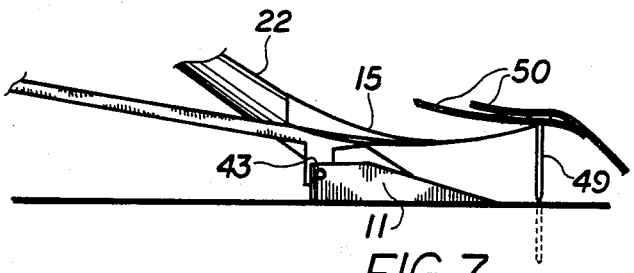
FIG. 7 is a partial side elevation of the device of FIG. 6 after actuation whereby the roofing material and its fastening nail have been loosened from their secured position on the roof deck.

It will be apparent that upon actuation the roofing material is raised very sharply from the roof deck such that the fastener is well loosened, and the complete detachment of the roofing material is made an almost effortless manual step as shown in FIG. 7. While piston rod 27 is depressing lifting plate 15, it extends from cylinder and piston 29 about 4 inches to trailing section 18.

FIG. 3 shows the configuration of the actuating means and guide handle 37 that are attached to shaft member 22. The actuating means includes the appendant fluid supply control box 36, trigger means 41, and fluid lines 33 and 34.

Figure 4:
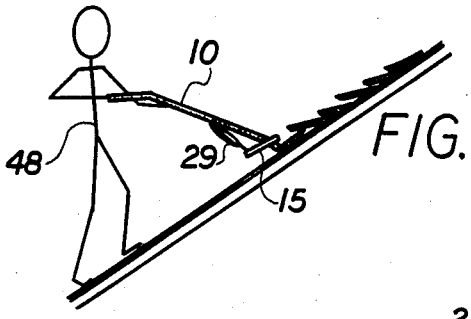
FIG. 4 is a schematic view of a workman on a sloped roof placing the material removing device of the present invention into the proper position prior to actuation.
Figure 5:
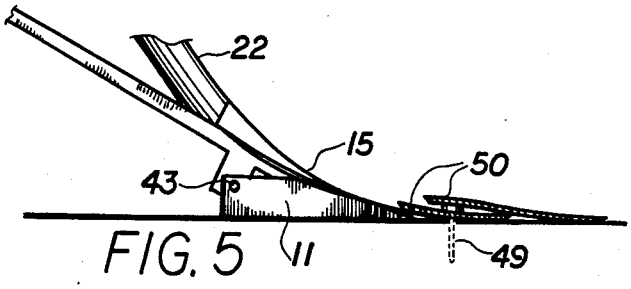
FIG. 5 is a partial side elevation of the device of FIG. 4 showing the proper positioning prior to actuation.
Figure 6:
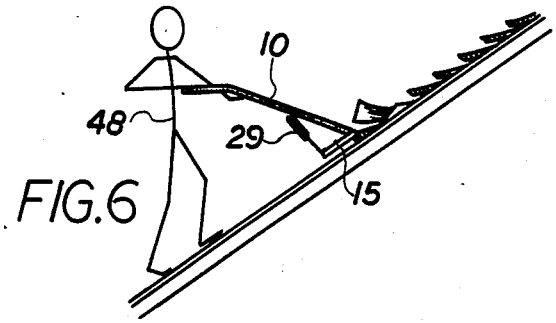
FIG. 6 is a schematic view of the workman in FIG. 4 actuating the material removing device of the present invention.

In FIG. 4, an operator 48 has positioned himself on a sloping roof and is placing device 10 in the proper position for operation as he works upwardly toward the roof apex. Alternatively, operator 48 could start at the roof apex and work downwardly toward the edge of the roof. The proper positioning of device 10 is shown in FIG. 5. The apparatus as positioned is now ready for use. FIG. 6 shows operator 48 after he has activated device 10 while FIG. 7 shows the loosened nail fastener 49 and roofing material 50.

While a single operator positions himself safely on a roof, either sloping or not, he pushes baseplate 11 and leading section 15A beneath the secured roofing material until serration 17 engages the fasteners of the roofing material to be loosened. The operator squeezes trigger means 41 located on guide handle 37, thus activating cylinder and piston 29. Piston rod 27 then depresses trailing section 18 of lifting plate 15. Concurrently, baseplate 11 remains firmly pressed against the roof.

Lifting plate 15 then elevates away from the roof deck, pulling up fasteners 49 and roofing material 50. The trigger means 41 is released and the process is repeated along the entire roof. The loosened roofing material can now be easily picked up for disposal by a companion worker or at a later time by the device operator.

While a presently preferred embodiment of the invention has been illustrated and described, variations and modifications may be apparent to those skilled in the art. These are contemplated as being within the scope of the following claims which particularly point out and distinctly claim the subject matter regarded as the invention.

We claim:

1. A device for removing roofing material comprising:
   - a baseplate;
   - a shaft member secured to a guide handle at its upper end and secured at its lower end to the baseplate;
   - a lifting plate including a blade-like leading section and a trailing section which are disposed in substantially the same plane;
   - a fulcrum means operatively secured to the baseplate and to the lifting plate;
   - an actuating means located on the guide handle and connected to a drive means; and
   - a drive means with a first end portion connected to the shaft member and a second end portion being hingeably secured to the trailing edge of the lifting plate, whereby actuation of the drive means downwardly depresses the trailing section of the lifting plate thereby rotating the lifting plate about the fulcrum means and moving the leading section of the lifting plate into a generally parallel spaced-apart position with respect to the baseplate.

2. The apparatus of claim 1 further comprising an opening located in the trailing section of the lifting plate to permit the lower end of the shaft member to pass therethrough.

3. The apparatus of claim 2 further comprising at least one serration located along the leading edge of the lifting plate.

4. The apparatus of claim 2 wherein the actuating means located on the guide handle includes a trigger means connected to a control box for activating the drive means when the trigger means is actuated.

5. The apparatus of claim 2 wherein the drive means comprises a piston rod and a fluid-operated piston and cylinder with an interruptable fluid supply operatively connected thereto.

6. The apparatus of claim 2 wherein the fulcrum means comprises two spaced apart pairs of opposing brackets, one pair connected to the baseplate and the other pair connected to the lifting plate each having aligned bore holes that slidingly admit a secured bolt such that the pair of bolts defines the axis of rotation of the fulcrum means.

7. The apparatus of claim. 2 wherein the angle between the baseplate and the lifting plate before actuating the drive means is less than 45°.

8. The apparatus of claim 2 wherein the shaft member is in a substantially normal direction to the baseplate.

9. A device for removing material comprising:
   - a baseplate;
   - a shaft member secured to a guide handle at its upper end and secured at its lower end to the baseplate;
   - a lifting plate including a blade-like leading section and a trailing section which are disposed in substantially the same plane;
   - a fulcrum means operatively secured to the baseplate and to the lifting plate;
   - an actuating means located on the guide handle and connected to a drive means; and
   - a drive means with a first end portion connected to the shaft member and a second end portion being hingeably secured to the trailing edge of the lifting plate, whereby actuation of the drive means downwardly depresses the trailing section of the lifting plate thereby rotating the lifting plate about the fulcrum means and moving the leading section of the lifting plate into a generally parallel spaced-apart position with respect to the baseplate.

* * * * *

UNITED STATES PATENT AND TRADEMARK OFFICE

CERTIFICATE OF CORRECTION

PATENT NO. : 4,663,995

DATED : May 12, 1987

INVENTOR(S) : Frank M. Amundson et al.

It is certified that error appears in the above-identified patent and that said Letters Patent is hereby corrected as shown below:

On the title page insert -- [73] Assignee: Femco Machine Co., Punxsutawney, Pa. and Herbert C. Manners, part interest --.

Signed and Sealed this

Eighth Day of November, 1988

*Attest:*

DONALD J. QUIGG

*Attesting Officer*

*Commissioner of Patents and Trademarks*